US007119755B2

(12) United States Patent
Harvey

(10) Patent No.: US 7,119,755 B2
(45) Date of Patent: Oct. 10, 2006

(54) WAVE ANTENNA LENS SYSTEM

(75) Inventor: Robin J. Harvey, Newbury Park, CA (US)

(73) Assignee: HRL Laboratories, LLC, Malibu, CA (US)

( * ) Notice: Subject to any disclaimer, the term of this patent is extended or adjusted under 35 U.S.C. 154(b) by 11 days.

(21) Appl. No.: 10/824,568

(22) Filed: Apr. 13, 2004

(65) Prior Publication Data

US 2004/0257300 A1 Dec. 23, 2004

Related U.S. Application Data

(60) Provisional application No. 60/480,343, filed on Jun. 20, 2003.

(51) Int. Cl.
*H01Q 13/00* (2006.01)

(52) U.S. Cl. ..... 343/785; 343/909; 343/911 R

(58) Field of Classification Search ..... 343/753, 343/754, 785, 786, 909, 911 L, 911 R; 333/21 R, 333/248

See application file for complete search history.

(56) References Cited

U.S. PATENT DOCUMENTS

| | | | | |
|---|---|---|---|---|
| 3,858,214 | A * | 12/1974 | Jones, Jr. | 342/362 |
| 4,274,097 | A | 6/1981 | Krall et al. | 343/719 |
| 4,293,833 | A | 10/1981 | Popa | 333/239 |
| 4,468,672 | A * | 8/1984 | Dragone | 343/783 |
| 4,673,947 | A * | 6/1987 | Newham | 343/781 CA |
| 4,785,306 | A | 11/1988 | Adams | 343/786 |
| 4,800,350 | A | 1/1989 | Bridges et al. | 333/329 |
| 5,166,698 | A | 11/1992 | Ashbaugh et al. | 343/783 |
| 5,684,495 | A | 11/1997 | Dyott et al. | 343/785 |
| 5,757,323 | A * | 5/1998 | Spencer | 343/700 MS |
| 5,936,589 | A * | 8/1999 | Kawahata | 343/785 |
| 6,137,450 | A * | 10/2000 | Bhattacharyya et al. | 343/786 |
| 6,266,025 | B1 | 7/2001 | Popa et al. | 343/785 |
| 6,353,417 | B1 * | 3/2002 | Yuanzhu | 343/785 |
| 6,501,433 | B1 | 12/2002 | Popa et al. | 343/785 |
| 6,714,165 | B1 * | 3/2004 | Verstraeten | 343/772 |

FOREIGN PATENT DOCUMENTS

| | | |
|---|---|---|
| EP | 0 443 526 A1 | 8/1991 |
| JP | 10-256822 | 9/1998 |
| WO | 01/52354 A1 | 7/2001 |

OTHER PUBLICATIONS

Lo, Y.T. and S.W. Lee, "Antenna Applications," *Antenna Handbook*, vol. III, Van Nostrand Reinhold, New York, pp. 17-36 to 17-48, 1993.

Bruno, W.M., et al., "Flexible Dielectric Waveguides with Power Cores," *IEEE Transactions on Microwave Theory and Techniques*, vol. 36, No. 5, pp. 882-890 (May 1998).

Kraus, J., *Antennas*, Second Edition, Mc-Graw Hill, Inc., pp. 685-687.

Mueller, G.E., et al., "Polyrod Antennas," *Bell System Technical Journal*, vol. XXVI, pp. 837-851 (Oct. 1947).

* cited by examiner

*Primary Examiner*—Tho Phan
(74) *Attorney, Agent, or Firm*—Ladas & Parry LLP

(57) ABSTRACT

An array of dielectric wave antennas is disclosed. Each wave antenna has a central dielectric portion and two dielectric tapered portions, disposed on opposite sides of the central dielectric portion. The array is deployed in a lens shape and allows variation of the phase delay of an incident electromagnetic wave when passing through the array.

9 Claims, 3 Drawing Sheets

WAVE ANTENNA LENS SYSTEM

CLAIM OF BENEFIT OF PROVISIONAL APPLICATION

This application claims the benefit of U.S. provisional application Ser. No. 60/480,343 filed on Jun. 20, 2003, which is incorporated herein by reference in its entirety.

BACKGROUND

1. Field

The present disclosure relates to a wave antenna system. In particular, a wave antenna lens system comprising a double-ended array of wave antennas deployed in a lens shape is disclosed.

The system disclosed in the present application can be applied to a wide range of microwave and millimeter wave antennas, where quasi-optical elements, i.e. elements having properties resembling those of optical elements, can improve performance, for example by focusing radiation in antenna systems. In particular, the lens system disclosed in the present application can be used to replace a fixed reflector or a lens, for example in satellite tracking applications.

2. Description of related art

There are a number of mechanisms that are classically used to focus radiation in antenna systems:

a) Mirrors and focal plane sensors, where a lens or a reflecting metal surface can be used to focus radiation. Typical satellite antennas are provided with a detector at the focus of an offset parabolic reflector, like for example in DirecTV or DirecPC applications. The parabola is offset for reasons related to beam blockage and diffraction by the supports.

b) Lens systems. However, these kinds of systems are less used in the microwave bands because of the dimensions, performance (reflective losses) and costs of the lenses when compared with those of a metal mirror. In fact, while optical lenses can have anti-reflecting coatings, these coatings are often not suited to coherent microwaves.

c) Thin lenses making use of Fresnel designs, such as used in the optical domain. However, for longer wavelengths, the step size must correspond to integer wavelengths, in order to avoid strong grating lobes due to diffraction at these locations. The grating lobe problem limits the utility of the lens for tracking.

d) Transmitting Fresnel zone plates. Again, there are beam steering issues that make this difficult.

e) Rotman-Turner lens, where a pair of one- or two-dimensional arrays of horns are connected together via waveguide links. Each link has a fixed phase delay designed to produce a phase shift equivalent to that of a lens. However, horns and metallic guides are needed.

SUMMARY

The present disclosure is suited to replace a lens for use with an antenna system with an array of antennas whose outer dimensions are similar to those of a lens. Such system has a lighter weight when compared with that of a lens, thus enabling simpler mounting and steering assemblies, and is capable of performing the function of an optical lens, such as focusing remote signals to a detector. The weight savings are a direct consequence of the empty space between the antennas forming the array.

According to a first aspect, a wave antenna system is disclosed, having a plurality of wave antennas, each wave antenna comprising: a central dielectric portion having a first side and a second side opposite the first side; a first dielectric taper portion having a first dielectric taper portion proximal side connected with the first side of the central dielectric portion and a first dielectric taper portion distal side; and a second dielectric taper portion having a second dielectric taper portion proximal side connected with the second side of the central dielectric portion and a second dielectric taper portion distal side.

According to a second aspect, a wave antenna is disclosed, comprising: a central dielectric portion, acting as a waveguide, having a first side and a second side opposite the first side; a first dielectric taper portion connected with the first side of the central dielectric portion; and a second dielectric taper portion connected with the second side of the central dielectric portion.

According to a third aspect, an array of wave antennas is disclosed, each wave antenna comprising: a central dielectric portion, acting as a waveguide, having a first side and a second side opposite the first side; a first dielectric taper portion connected with the first side of the central dielectric portion; and a second dielectric taper portion connected with the second side of the central dielectric portion, wherein the central dielectric portions have a length, said length being variable among individual wave antennas, the array exhibiting a lens-shaped periphery by virtue of said variable length.

According to a fourth aspect, an array of wave antennas is disclosed, each wave antenna comprising: a central dielectric portion, acting as a waveguide, having a first side and a second side opposite the first side; a first dielectric taper portion having a first dielectric taper proximate end connected with the first side of the central dielectric portion and a first dielectric taper distal end; and a second dielectric taper portion having a second dielectric taper proximate end connected with the second side of the central dielectric portion and a second dielectric taper distal end, wherein the distal ends of the first dielectric taper portions form a first surface of the array and the distal ends of the second taper portions form a second surface, and wherein incoming waves are captured by the first dielectric taper portions and re-emitted by the second taper portions.

According to a fifth aspect, a wave antenna system comprising a plurality of spaced apart wave antennas is disclosed, each wave antenna comprising: a central dielectric portion having a first side and a second side opposite the first side; a first dielectric taper portion having a first dielectric taper portion proximal side connected with the first side of the central dielectric portion and a first dielectric taper portion distal side, the first dielectric taper portion proximal side having a first dielectric taper proximal width, the first dielectric taper portion distal side having a first dielectric taper distal width, the first dielectric taper proximal width being greater than the first dielectric taper distal width; and a second dielectric taper portion having a second dielectric taper portion proximal side connected with the second side of the central dielectric portion and a second dielectric taper portion distal side, the second dielectric taper portion proximal side having a second dielectric taper proximal width, the second dielectric taper portion distal side having a second dielectric taper distal width, the second dielectric taper proximal width being greater than the second dielectric taper distal width.

According to a sixth aspect, a wave antenna is disclosed, comprising: a central dielectric portion, acting as a waveguide, having a first side and a second side opposite the first side; a first dielectric taper portion connected with the first side of the central dielectric portion, wherein a proximal thickness of the first dielectric taper portion proximal to the central dielectric portion is greater than a distal thickness of the first dielectric taper portion distal to the central dielectric portion; and a second dielectric taper portion connected with the second side of the central dielectric portion, wherein a proximal thickness of the second dielectric taper portion proximal to the central dielectric portion is greater than a distal thickness of the second dielectric taper portion distal to the central dielectric portion.

Wave antennas, also known as tapered rod antennas or shaped-wave antennas, are known as such. An introductory description of wave antennas can be found in Antenna Handbook, Vol III, Antenna Applications, Y. T. Lo and S. W. Lee 1993, Van Nostrand Reinhold, N.Y., pages 17–36 to 17–48. See also U.S. Pat. No. 6,266,025 and U.S. Pat. No. 6,501,433, which disclose coaxial dielectric rod antennas with multi-frequency collinear apertures.

The wave antenna elements of the array according to the present disclosure are thin dielectric rods tapered at their two ends. In the middle section, they behave like an optical waveguide. The central length of the guides is preferably varied to obtain the desired phase delay as a function of position across the aperture of the array, analogous to varying the thickness of a conventional dielectric lens with radius.

Conventional lenses have a central thickness that is set by the lens maker formulas. For a fixed f-number, this thickness grows with the aperture of the lens. Large diameter lenses for use with microwaves and millimeter waves need to be made of low loss materials that tend to be expensive and heavy. For example, an 18" lens, intended for focusing a satellite antenna, can exhibit a thickness of 3–4". A billet of high quality dielectric of this size (for example Rexolite™), can have a cost of $500.

A lens operates by introducing a phase shift in different parts of the wave as it passes through the lens. The portion of the wave passing through the thickest part of the lens gets the most phase shift. In a like manner, varying the length of the dielectric lens antenna elements across the face introduces varying phase shift to the wave as it passes through the array.

By using the system as disclosed in the present application, there is empty space between the elements. This means that the volume of dielectric required in the wave antenna is much less. Also the system mass scales as the cube of the index of refraction n. Therefore, the material requirements and cost of the array can be less that those of a conventional lens if the index of refraction n is high. The array itself can be held in a low cost mounting plate or molded as a unit.

The beam directivity gain and side lobe performance can be made to be equivalent to a reflector of similar dimensions. A lower reflective loss than a lens is also exhibited.

Additionally, no horns or metallic waveguides are needed, as in the prior art Rotman-Turner lenses and therefore a lower-cost approach can be followed.

BRIEF DESCRIPTION OF THE DRAWINGS

The present invention will be understood and appreciated more fully from the following detailed description taken in conjunction with the drawings in which.

DETAILED DESCRIPTION

Figure 1:
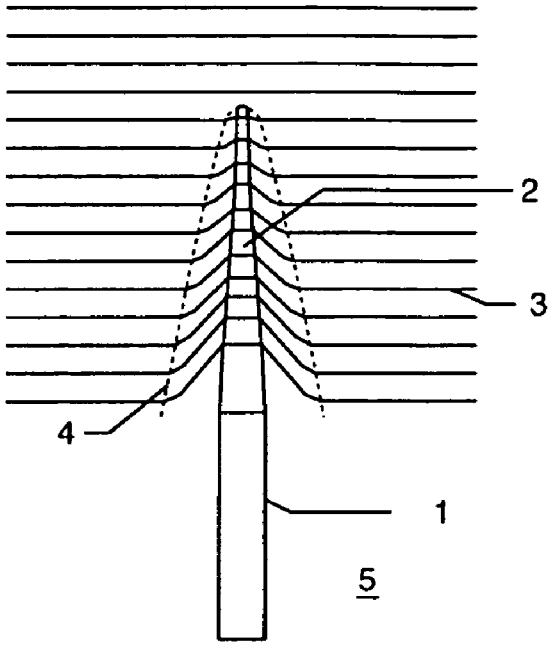
FIG. 1 PRIOR ART
FIG. 1 is a schematic diagram showing the basic elements of a prior art wave antenna.

FIG. 1 is a schematic diagram showing the basic elements of a wave antenna 5. The wave antenna 5 comprises a dielectric waveguide 1 connected to a dielectric taper 2. The cross section of the antenna is circular.

The dielectric waveguide 1 supports an HE11 mode, i.e. a hybrid electric mode in a dielectric, similar to the circular guide TE11 mode, and matching boundary conditions in absence of a metal wall. The dielectric taper 2 transforms HE11 modes into plane waves 3 moving in free space.

The wave antenna 5 is used to couple a plane wave into a mating waveguide of diameter $d<0.626\ \lambda_0/n$. The gain G of the antenna is approximately proportional to the length L of the antenna (i.e. the combined length of the dielectric waveguide 1 and the dielectric taper 2), $G=7L/\lambda_0$, and the half-power beam width is $\Delta\theta=55\ (\lambda_0/L)^{1/2}$. The sidelobe performance and directivity gain are equivalent to a parabolic dish if $(L/\lambda_0)\sim(D/\lambda_0)^2$, where $\lambda_0$ is the free space wavelength, d is the wavelength diameter, θ is the beam angle, and D is the diameter of the antenna influence.

As indicated by the dotted line 4 in FIG. 1, the influence of the antenna on the space around it extends radially outward, for a distance that is proportional to the square root of its length, according to the formula $$D/\lambda_0\sim(L/\lambda_0)^{1/2}$$

Figure 2:
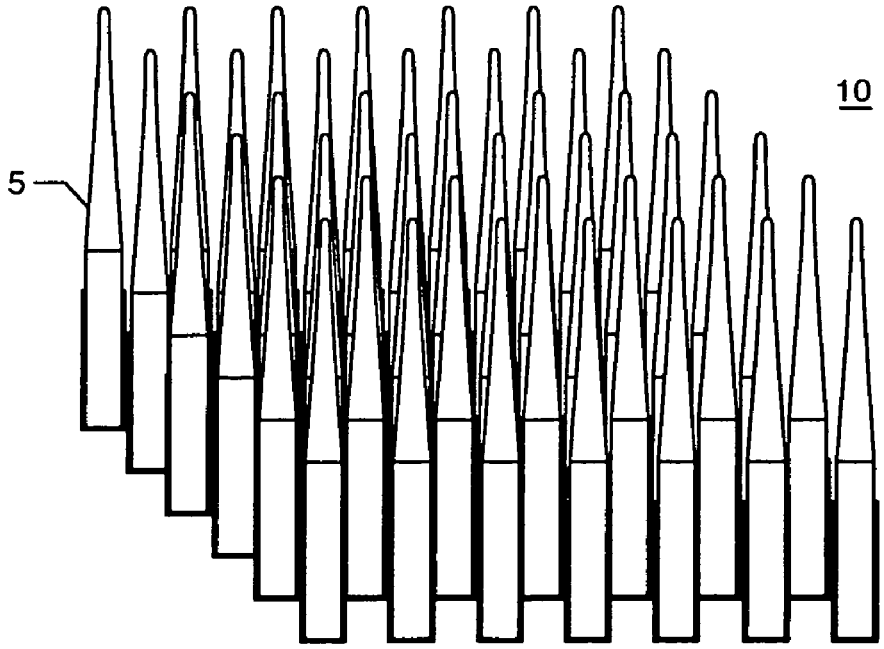
FIG. 2 PRIOR ART
FIG. 2 is a perspective view showing a prior art configuration of an array of antennas.

FIG. 2 shows a prior art configuration of an array 10 of wave antennas or antenna elements 5 of the type described in FIG. 1. The base of each antenna 5 is provided with a resonant coupler and with diode sensors (not shown) for detecting the incoming signal at each array point. Due to the axial symmetry of the individual antenna elements 5, the diode sensors may be oriented to electronically select the polarization of the wave of interest. The spacing of the antenna elements takes into account the beam pattern of each wave antenna, as well as the grating lobe contribution, due to the finite number of elements forming the array. The related mathematical analysis is similar to the analysis for an array of conventional horns or dish type antennas. Nominally, low gain array elements are spaced apart by ½ wave length. The gain of a wave antenna may extend from 10 dB upwards to 25 dB, enabling a somewhat wider element spacing. Design tradeoffs are associated with sparse arrays involving element spacing efficiency, and the field of view of the array. In particular, the field of view is best within the beam width of an array element that correspondingly varies from over 50° to less than 10°.

According to the present disclosure, the dielectric sections of two like wave antennas are joined at their guide ends, in a back-to-back configuration.

Figure 3:
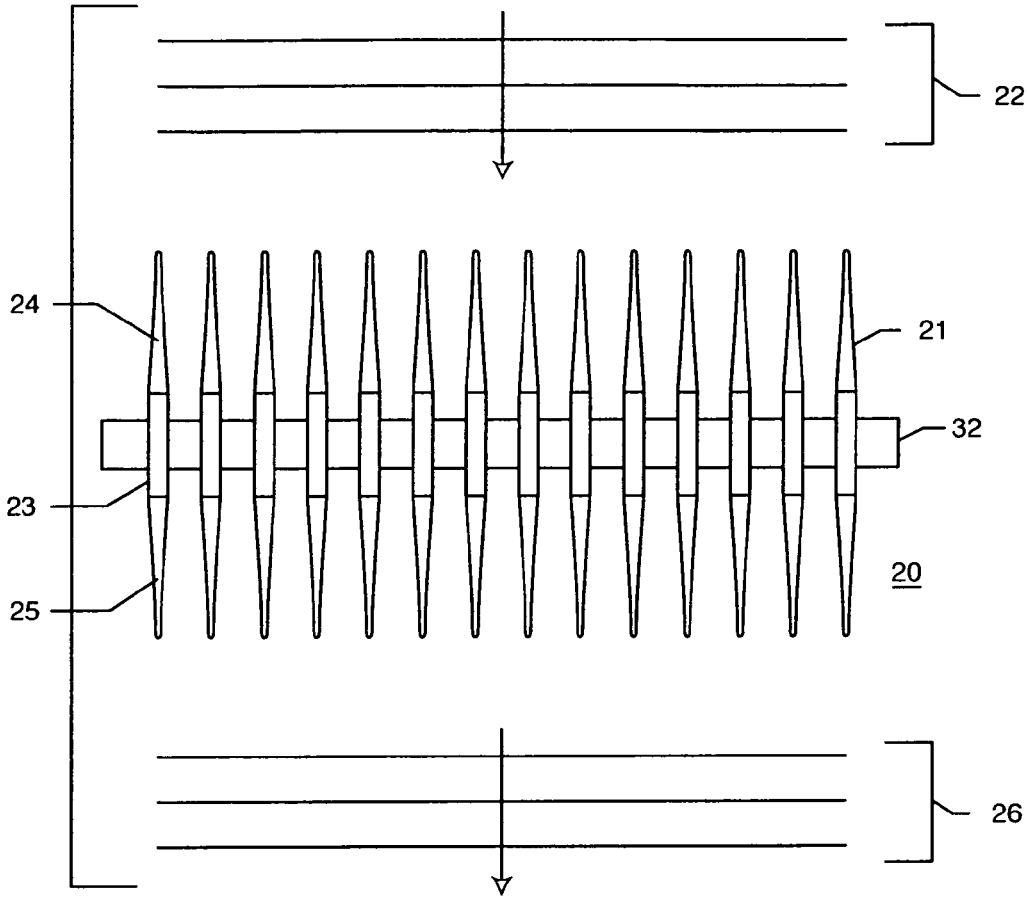
FIG. 3 shows a cross-section view of a back-to-back configuration of antennas according to a first embodiment of the present invention.

FIG. 3 shows a first embodiment according to the present invention, where a cross section of a linear array 20 of back-to-back antennas 21 connected across a central plane 32, also shown in cross section, is provided. A two-dimensional array of this type acts as a passive repeater of an incident electromagnetic wave. In particular, arriving plane waves 22 are captured by the antenna elements 21, delayed uniformly according to the length of the waveguides 23 linking them, and then re-emitted into the original direction as plane waves 26.

The central waveguide 23, the upper taper 24 and the lower taper 25 of each antenna of the array are made of dielectric material. The best orientation of the array is perpendicular to the incoming radiation, in which case the propagation will be along the central axis.

In the embodiment of FIG. 3, both the upper taper 24 and the lower taper 25 have a proximal side connected with the central waveguide 23 and a distal side, wherein the proximal side has a width or thickness which is greater than the width or thickness of the distal side. In this way, a symmetrical or substantially symmetrical configuration is advantageously obtained.

According to the present disclosure, arriving plane waves are focused by varying the length of the central waveguides of the antenna elements.

Figure 4:
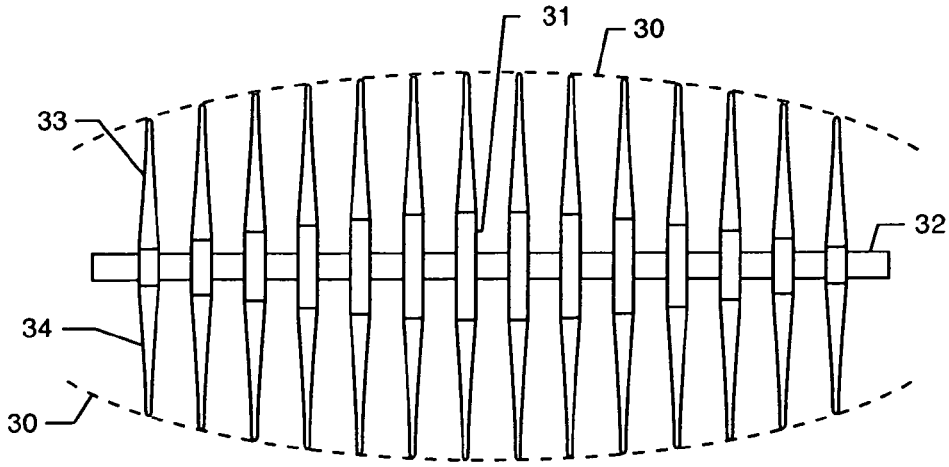
FIG. 4 is a cross section view of an array of antennas according to a second embodiment of the present invention.

FIG. 4 is a cross-section view showing a second embodiment of the present invention, where the linear array of antennas has the outer dimensions of a lens, for example a double-convex lens, as indicated by dashed line 30. In particular, according to this preferred embodiment, the length of the central waveguides 31 of the individual antennas is varied in the same manner as a conventional lens, while the length of the upper and lower tapered sections 33, 34 is the same for all elements. In the case of FIG. 4, the lens is a positive lens intended for collimating a signal in a manner indicated in the subsequent FIG. 6. The person skilled in the art will recognize that other shapes of a lens are also possible, such as a plano-convex lens, a plano-concave lens, a double concave lens, etc.

The central plane 32 crossed by the array of wave antennas may be constructed of different materials such as low index dielectrics (following fiber-optic design rules) or metals (following waveguide coupling design rules for conventional waveguide antennas) in order to avoid reflections at the mounting boundaries. Therefore, in the preferred embodiment, the central plane 32 both supports the antenna elements and minimizes reflections. Any shape of the central plane or spacing of elements is possible.

Since most of the wave energy coupled is within the guide, the HE11 mode can easily propagate through the interface with a low-cost low index dielectric, without significant loss. Reflective losses depend upon the taper. For example, with a dielectric index of $\epsilon=2.56$, an aspect ratio in the shape of the taper of 3 or more would assure a reflection coefficient of around 2.5% or even less from each of the two surfaces. The equivalent factor in a solid dielectric lens, where the reflection coefficient of a lens surface is given by the formula $[(1-n)/(1+n)]^2$, would be 19%.

Figure 5:
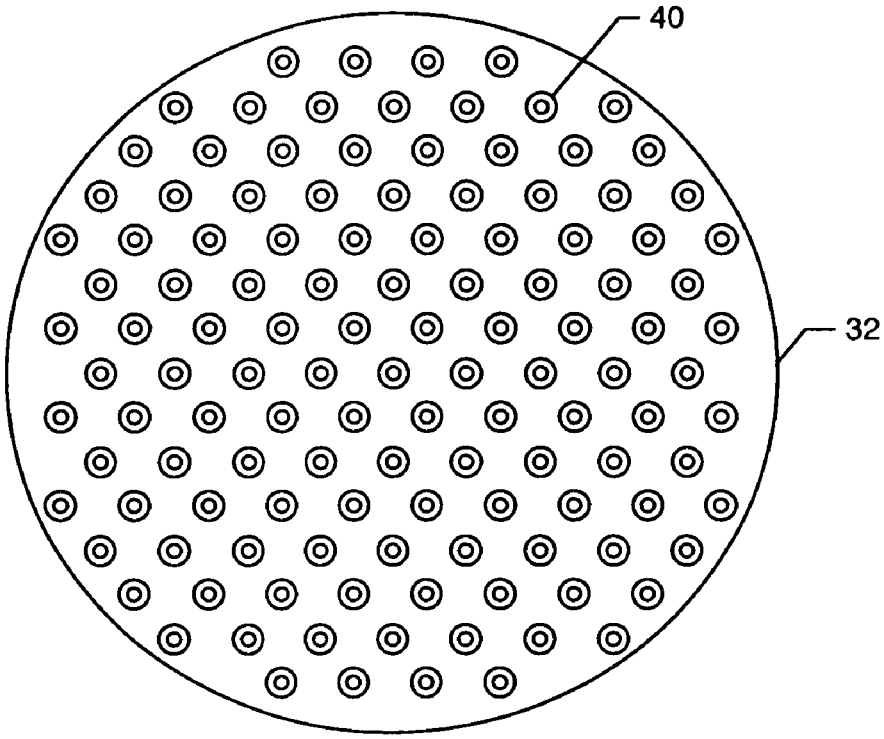
FIG. 5 is a top plan view of an array of antennas according to the preferred embodiment of the present invention.

FIG. 5 shows a top or bottom view of the preferred embodiment of the array according to the present invention. The central plane 32 has a circular shape. The array of antennas is a substantially hexagonal arrangement of the elements 40 along the central plane 32. The hexagonal array represents an efficient filling of a circular plane which at the same time balances the interaction of each element with its nearest neighbors.

Figure 6:
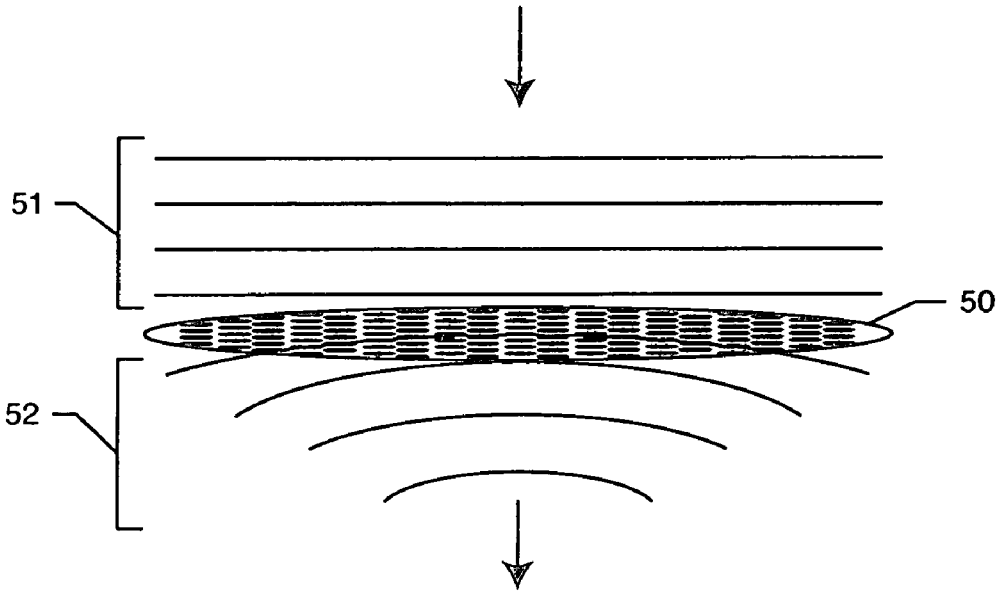
FIG. 6 is a schematic diagram showing the lens-like focusing action of the array according to the present invention.

FIG. 6 shows the lens-like focusing action of the array shown in FIGS. 4 and 5, schematically indicated with numeral 50. The Figure shows an incoming plane wave 51 (horizontal lines) which is focused (curved lines 52) when passing through the lens array 50.

A number of choices exist for the type of taper to be used in the present invention, for example: a) circularly symmetric linear; b) circularly symmetric parabolic; c) linear with a full-prismatic cross-section; or d) linear with a half-prismatic cross section. See also Antenna Handbook, Vol III, supra, page 17–37.

The high-dielectric wave-antenna parts may be cast or molded and later held in place with low-cost rigid foam. The resulting assembly will be overall light weight for tracking and mounting purposes. When the field of view can be reduced, the volumetric densities improve further, since higher elemental gain allows for less antenna elements.

It will be appreciated that the present invention is not limited to what has been particularly shown and described herein above. Rather the scope of the present invention is defined by the claims which follow.

For example, many other configurations, and lens types, may be formed by applying the above principles. Also, the person skilled in the art will appreciate, upon reading the present disclosure, that the tapered dielectric or the waveguide dielectric sections may be individually bent or aimed to adjust the pointing direction and overall gain of the array. Such additional control is not available in conventional lenses.

What is claimed is:

1. A wave antenna system comprising a plurality of spaced apart wave antennas, each wave antenna comprising:

a central dielectric portion having a first side and a second side opposite the first side;

a first dielectric taper portion having a first dielectric taper portion proximal side connected with the first side of the central dielectric portion and a first dielectric taper portion distal side; and a second dielectric taper portion having a second dielectric taper portion proximal side connected with the second side of the central dielectric portion and a second dielectric taper portion distal side, wherein the system further comprises a plane supporting the plurality of wave antennas, wherein the plane has a first plane side and a second plane side and the wave antennas are inserted in the plane, the first dielectric taper portion located above the first plane side, and the second dielectric taper portion located below the second plane side, and wherein the wave antennas are disposed in an array configuration, the array configuration having a peripheral share formed by distal portions of the first and second dielectric taper portions, the peripheral shape being lens-shaped.

2. The system of claim 1, wherein the wave antennas are inserted in the plane perpendicularly to the plane.

3. The system of claim 1, wherein the wave antennas are disposed in a substantially hexagonal configuration.

4. The system of claim 1, wherein the peripheral shape is chosen from a group consisting of a double convex lens, a double concave lens, a plano-convex lens, and a plano-concave lens.

5. The system of claim 1, wherein at least one between the first dielectric taper portion and the second dielectric taper portion is bendable.

6. An array of wave antennas, each wave antenna comprising:

a central dielectric portion, acting as a waveguide, having a first side and a second side opposite the first side;

a first dielectric taper portion connected with the first side of the central dielectric portion; and a second dielectric taper portion connected with the second side of the central dielectric portion, wherein the central dielectric portions have a length, said length being variable among individual wave antennas, the array exhibiting a lens-shaped periphery by virtue of said variable length.

7. The array of claim 6, wherein the first and second dielectric taper portions have a length, the length of the first and second dielectric taper portions being the same along the array.

8. The array of claim 6, wherein at least one between the first taper portion and the second taper portion is bendable.

9. A wave antenna system comprising a plurality of spaced apart wave antennas, each wave antenna comprising:

a central dielectric portion having a first side and a second side opposite the first side;

a first dielectric taper portion having a first dielectric taper portion proximal side connected with the first side of the central dielectric portion and a first dielectric taper portion distal side, the first dielectric taper portion proximal side having a first dielectric taper proximal width, the first dielectric taper portion distal side having a first dielectric taper distal width, the first dielectric taper proximal width being greater than the first dielectric taper distal width; and a second dielectric taper portion having a second dielectric taper portion proximal side connected with the second side of the central dielectric portion and a second dielectric taper portion distal side, the second dielectric taper portion proximal side having a second dielectric taper proximal width, the second dielectric taper portion distal side having a second dielectric taper distal width, the second dielectric taper proximal width being greater than the second dielectric taper distal width, wherein the central dielectric portions have a length, said length being variable among individual wave antennas, the array exhibiting a lens-shaped periphery by virtue of said variable length.

* * * * *